US006098442A

United States Patent [19]

Walldorf et al.

[11] Patent Number: 6,098,442

[45] Date of Patent: Aug. 8, 2000

[54] FASTENING DEVICE AND METHOD AND APPARATUS FOR SUPPLYING FASTENING ELEMENTS THERETO

[75] Inventors: Hugo Walldorf, Giessen-Rodgen; Daniel Eisenhardt, Bad Camberg, both of Germany

[73] Assignee: Emhart Inc., Newark, Del.

[21] Appl. No.: 09/070,796

[22] Filed: May 1, 1998

Related U.S. Application Data

[63] Continuation-in-part of application No. 08/954,764, Oct. 20, 1997, abandoned.

[51] Int. Cl.[7] ..... B21J 15/32

[52] U.S. Cl. ..... 72/391.6; 29/525.06; 227/15; 227/18; 227/136

[58] Field of Search ..... 227/136, 15, 16, 227/18; 72/391.6; 29/524.1, 525.06, 525.07

[56] References Cited

U.S. PATENT DOCUMENTS

| | | | |
|---|---|---|---|
| 2,495,070 | 1/1950 | Mellodge | 72/391.6 |
| 3,797,107 | 3/1974 | Anhalt et al. | 29/525.06 |
| 4,121,487 | 10/1978 | Bone . | |
| 4,131,009 | 12/1978 | Hara et al. | 72/391.6 |
| 4,178,669 | 12/1979 | Hara et al. | 29/525.06 |
| 4,932,821 | 6/1990 | Steffan et al. . | |
| 5,184,497 | 2/1993 | Hanlon et al. | 72/391.6 |
| 5,327,639 | 7/1994 | Wing et al. | 29/525.06 |
| 5,388,721 | 2/1995 | Mauer | 221/74 |
| 5,478,051 | 12/1995 | Mauer . | |
| 5,651,169 | 7/1997 | Ohuchi et al. | 29/525.06 |

FOREIGN PATENT DOCUMENTS

| | | |
|---|---|---|
| 0506307 | 9/1992 | European Pat. Off. . |
| 2829566 | 1/1979 | Germany . |
| 2737602 | 3/1979 | Germany . |
| 3606901 | 9/1987 | Germany . |
| 2002845 | 2/1979 | United Kingdom . |

*Primary Examiner*—David Jones
*Attorney, Agent, or Firm*—Edward D. Murphy

[57] ABSTRACT

A fastening device (30) includes a housing (32) and a handle (34) extending from a first side of the housing to assume a pistol-like configuration. A head (38) is located at a forward end of the housing (32) and includes a nose member (40) located between two spaced housing parts or guide plates (41) and (42). A magazine (36) is attached to the nose member (40) adjacent a second side of the housing (32), opposite the first side thereof. A plurality of spaced, serially-arranged fastening elements (44) are linked together in a belt-like fashion, and are located within the magazine (36) for feeding and conveying of the fastening elements to a forward fitting position or assembly station (46) at a forward end of the nose member (40).

19 Claims, 15 Drawing Sheets

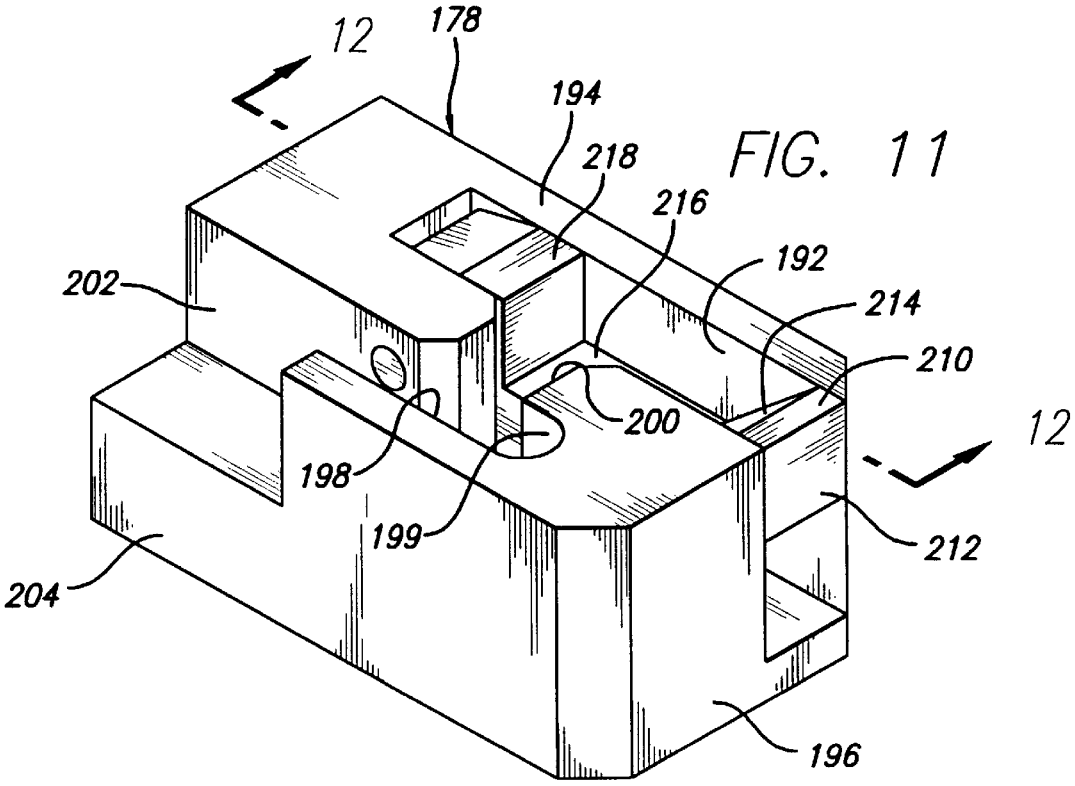
FIG. 11
FIG. 12
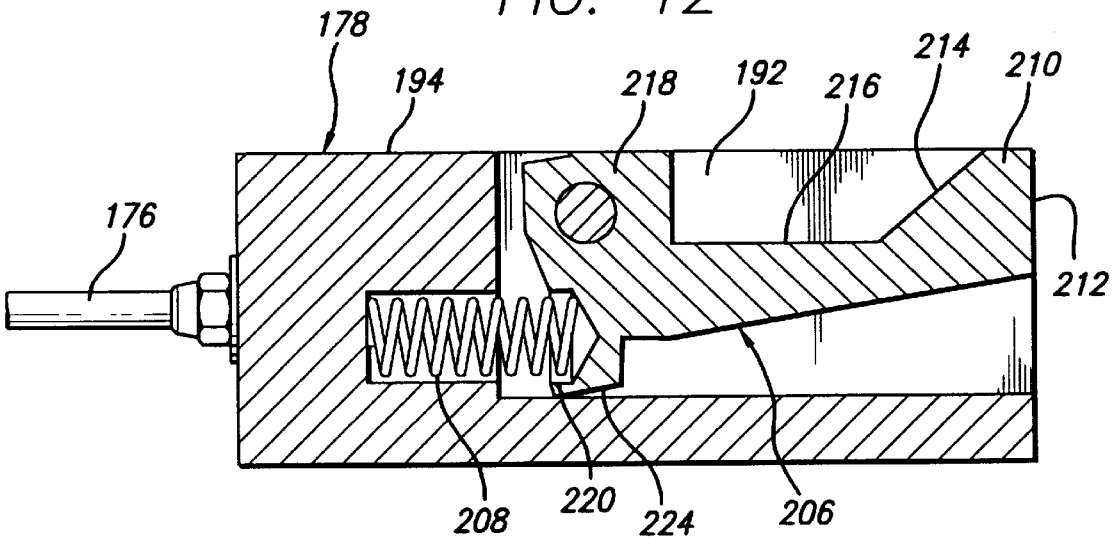

254
256
257
258
260
262
264
266
268
270
272
274
276
278
280
282
284
286
288
290
290a
302
304
306
308
310

FASTENING DEVICE AND METHOD AND APPARATUS FOR SUPPLYING FASTENING ELEMENTS THERETO

This application is a continuation-in-part of application Ser. No. 08/954,764, filed Oct. 20, 1997, now abandoned.

BACKGROUND OF THE INVENTION

This invention relates to a fastening device and particularly relates to a fastening device for applying fastening elements to a structure.

Fastening elements, in particular those composed of plastic materials, have a broad field of application. For example, plastic fastening elements are used for fastening parts or components of motor vehicles to the body or frame of such vehicles, and can be of a variety of designs to suit the particular structural need.

Typically, the fastening element can be fastened or applied to a structure by means of a jointing tool, which can be supplied with individual fastening elements. The supplying of individual unconnected fastening elements to the jointing tool is a relatively expensive process. To provide a more efficient and less costly process of feeding the fastening elements to and through the jointing tool, and applying the elements to the structure, a system has been developed for linking successive fastening elements in the form of a supply belt. A system in which the fastening elements are linked to form a supply belt is disclosed in U.S. Pat. No. 5,478,051, which issued on Dec. 26, 1995, to Deiter Mauer.

The individual fastening elements are linked together in a proper spacial relationship to facilitate assembly thereof with the structure. The successive fastening elements are connected to form the belt and include guide elements on one or both sides of the fastening elements which are linked by monofilaments molded with the guide elements in a single stage of manufacture. The belt of the flexible fastening elements can be wound onto a drum and eventually transferred to the jointing tool. With the availability of the supply belt of fastening elements, the problems previously encountered when sorting and feeding individual elements to the tool have been eliminated.

Since the guide elements are identical and are, therefore, standardized regardless of the structure of the fastening elements, the advance and exact positioning of each fastening element is thus achieved. The linked fastening elements are feed through the jointing tool, where the lead fastening element is properly positioned adjacent the location of the structure at which the element is to be assembled. The lead fastening element is then separated from the linking guide elements and the monofilaments and assembled with the structure, whereafter the guide elements and the monofilaments are collected and transported to a recycling location.

With known jointing tools, fixed or stationary devices are used to apply fastening elements to a structure. The advantage of these stationary devices is that relatively large quantities of fastening elements can be stored in a drum. However, such known devices can only be used if the receiving structure can be brought to the device. With relatively complicated structures, the structures have to be appropriately handled and manipulated for the application of individual fastening elements which are not to be located in a given plane. Such handling of the structure is not always possible, as in the case of a motor vehicle body, for example. The known stationary device also has limitations in the application of fastening elements in the interior of a structure.

A prior fitting arrangement for applying a spring nut to a fastening peg projecting from a buffer rail is disclosed in German Patent No. DE 27 37 602 A1, which was published on Mar. 1, 1979. The fitting arrangement has a pistol-like housing. A working unit comprising a plunger actuated by compressed air for depressing the spring nut is arranged in the housing. The spring nuts are brought into a fitting position through a feed duct extending substantially perpendicularly to the direction of movement of the plunger. The feed duct is connected to a flat drum which acts as a magazine for the spring nuts. A coil of the spring nuts is arranged in the flat drum.

Another prior fitting arrangement for the application of nails is disclosed in German Patent No. DE 36 06 901, which was published on Sep. 10, 1987. The fitting arrangement comprises a opening in which a movable piston is located. A radial duct, substantially formed by a hollow profile, is formed with an orifice in which the piston is movable. Several nails are connected together by guide bushings which are located in the radial duct.

Also, German Patent No. DE 28 29 566, which was published on Jan. 25, 1979, discloses a device for applying fastening elements to a structure with a magazine for receiving fastening elements which are connected together in the form of a belt. The device comprises a conveyor unit which conveys each fastening into a predetermined fitting position. The device also comprises an automatically operating working unit with a rectilinearly reciprocation tool by means of which a fastening element can be applied from the fitting position onto a structure. The working unit is actuated by use of an actuating arrangement.

The magazine is designed in the form of a container or a bushing. The fastening elements are firstly are formed in a roll and arranged in the magazine which is designed as a bushing, for which purpose a press-fit lid has to be removed from the a body of the bushing. The roll, with a portion of the fastening elements, can then be inserted through an inlet orifice.

Due to the shape of the magazine and its position relative to the housing of the device, handling of the device is relatively complicated because the device is relatively bulky in design.

SUMMARY OF THE INVENTION

It is, therefore, an object of this invention to provide a device which can be transported to a structure for the application of fastening elements to the structure.

Another object of this invention is to provide a fastening device for the application of fastening elements to a structure, which is easy to handle. It is a further object of the present invention to develop the fastening device with a conveying arrangement so as to allow safe, reliable conveyance of fastening means. It is a further object of the present invention to provide a fastening device which allows the simple and rapid supply of an arrangement of fastening elements for the application thereof. Still another object of the present invention is to provide an apparatus and a process for supplying a fastening device for the application of fastening elements to a structure.

With these and other objects in mind, this invention contemplates a fastening device for feeding and applying a fastener element to a structure which includes a feed track for receipt of the fastener element therein. A housing contains an assembly station whereat the fastener element is to be positioned for assembly with the structure. A conveying mechanism is located within the housing for selectively advancing the fastener element from the feed track to the assembly station. A driver is provided for advancing the fastener element from the assembly station into assembly with the structure.

This invention further contemplates a fastening device for applying fastening elements from a forward end of the device to a structure, and includes a magazine for receiving a predetermined number of the fastening elements in a web-connected manner. A magazine holder extends along an axis thereof from a first end to a second end thereof and is arranged to support the magazine substantially in parallel with the axis thereof. A housing part is coupled to and extends in a given direction from the magazine holder toward the forward end of the device. A conveyor arrangement is supported by the housing part for conveying each fastening element from the magazine into a predetermined fitting position at the forward end of the fastening device whereat the conveyed fastening element can be applied from the fitting position to the structure.

This invention also contemplates a fastening device for supplying fastening elements to a fitting position for subsequent insertion into a structure, and includes a feeder for supplying a succession of web-connected serially-arranged fastener elements. A support element is movable about an axis thereof and is located adjacent the feeder. A plurality of projections are coupled to, and extend from, a face of the support element. A carrier element has an end face which is positionable for engagement individually and serially with the projections. The carrier element is movable from a rest position to a forward position thereof in a direction to urge the end face into engagement with an adjacent one of the projections to move the adjacent projection thereby moving the support plate and the remaining projections. Means, formed on the support element and responsive to movement of the carrier element, is provided for engaging at least a leading fastening element from the feeder and for advancing the leading fastening element toward the fitting position.

This invention further contemplates a method of providing a fastening device having a magazine with a prescribed number of fastening elements, which includes the steps of forming a supply of web-connected serially-arranged fastening devices, feeding a prescribed number of the web-connected fastening devices into an empty magazine to thereby provide a loaded magazine, and connecting the loaded magazine to the fastening device.

This invention also contemplates an apparatus for effecting the process set forth above.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings:

FIG. 11 is a perspective view further showing details of the fastener-element advancing mechanism in accordance with certain principles of the invention;

FIG. 12 is a cross sectional view taken along line 12—12 of FIG. 11 further showing features of the fastener-element advancing mechanism in accordance with certain principles of the invention;

DETAILED DESCRIPTION OF THE PREFERRED EMBODIMENT OF THE INVENTION

Figure 1:
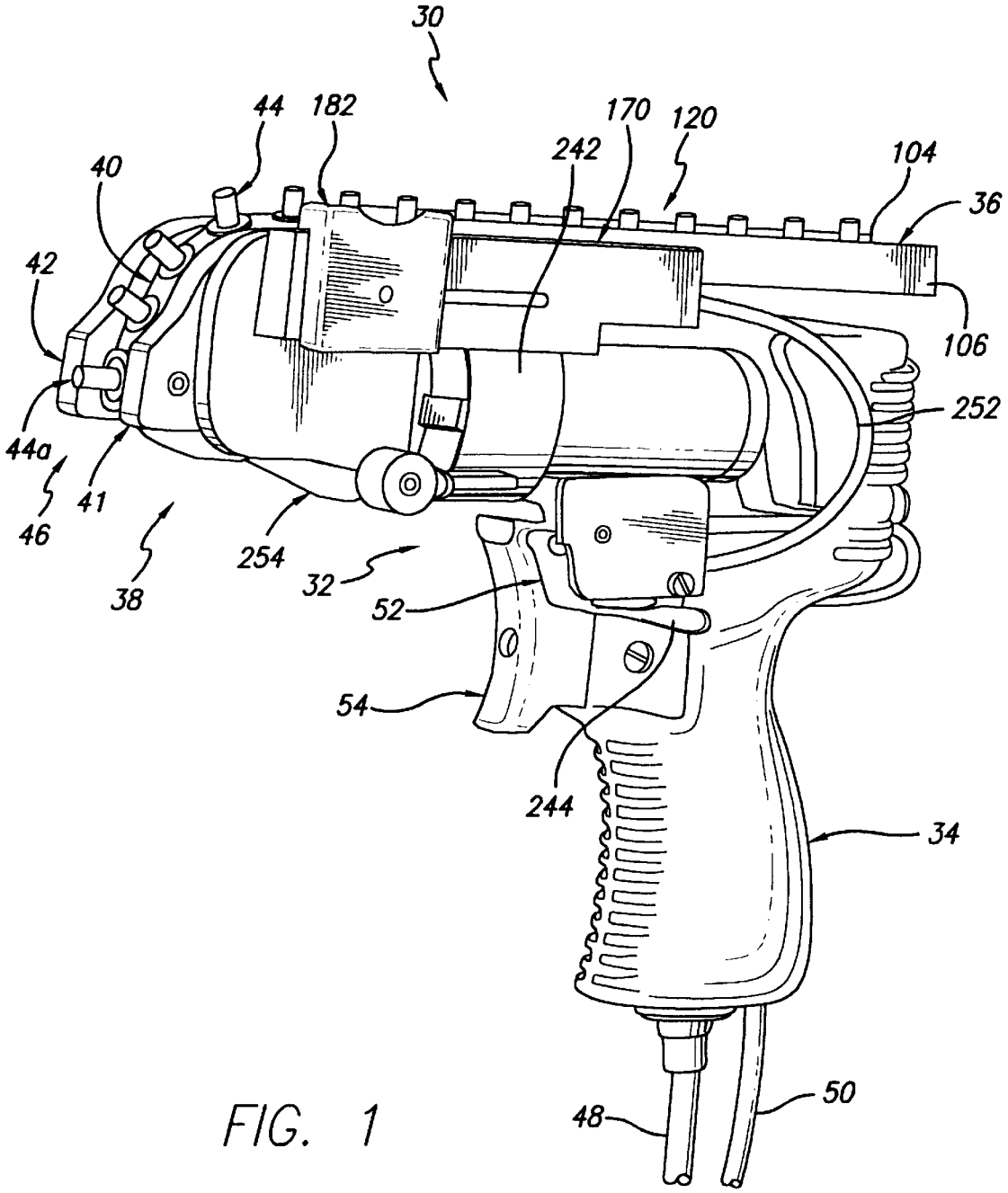
FIG. 1 is a perspective view showing a first, and preferred, embodiment of a pistol-like fastening device or tool in accordance with certain principles of the invention.

Referring to FIG. 1, a first and a preferred embodiment of a fastening device 30 includes a housing 32 and a handle 34 extending from a first side of the housing to assume a pistol-like configuration. A head 38 is located at a forward end of the housing 32 and includes a nose member 40 located between two spaced housing parts or guide plates 41 and 42. A magazine or feeder 36 is attached to the nose member 40 adjacent a second side of the housing 32, opposite the first side thereof.

A plurality of spaced, serially-arranged fastening elements 44 are linked together in a belt-like fashion, and are located within the magazine 36 for feeding and conveying of the fastening elements to a forward fitting position or assembly station 46 at a forward end of the nose member 40.

Pressurized air is provided through power supply lines 48 and 50 which are located at a lower end of the handle 34 and provide operating power for the fastening device 30. A lever arm 52 is located adjacent an upper portion of the handle 34 and is manually operable to facilitate selective and independent advancement of the fastening elements 44, including a lead fastening element 44*a*. A trigger-like actuator 54 is also located adjacent the upper portion of the handle 34, adjacent the lever arm 52, and is manually operable to facilitate selective and independent separation of the lead fastening element 44*a* from the linked fastening elements 44 which trail the lead fastening element.

Figures 2, 3:
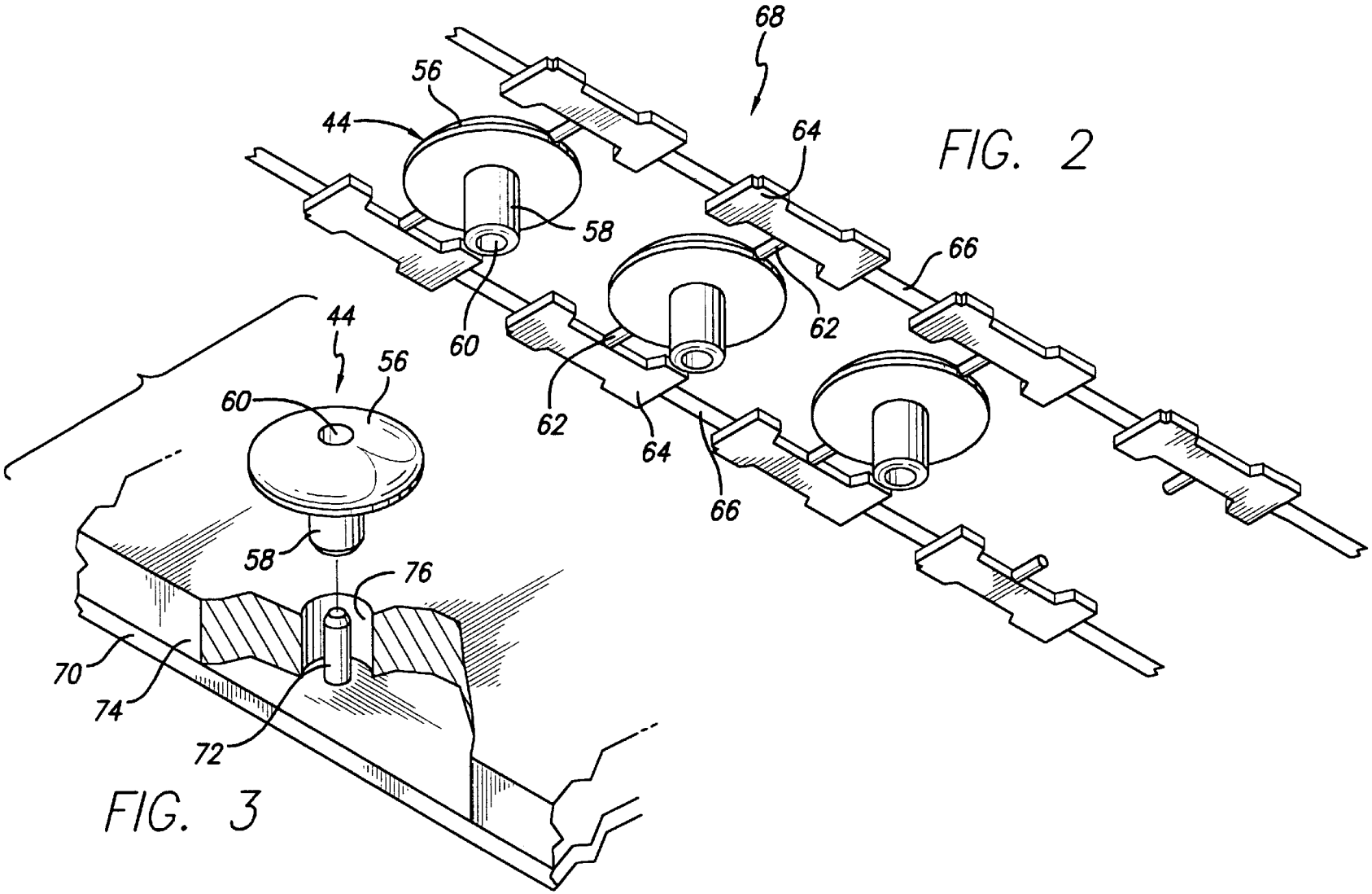
FIG. 2 is a perspective view showing a plurality of plastic fastener elements held in a serial, spaced arrangement by guide elements and monofilaments.
FIG. 3 is a perspective view showing one of the fastener elements of FIG. 2 in position for fastening assembly with structure to be fastened together.

As shown in FIG. 2, each of the fastening elements 44 is formed with a circular head 56 and a cylindrical sleeve 58, with an opening 60, extending centrally from one side of the head. Each fastening element 44 is joined or molded, through crosspieces 62, with guide elements 64 on opposite sides of the fastening element. The guide elements 64 of each fastening element 44 are joined or molded with a continuous thread or monofilament 66 to link the guide elements 64 of adjacent fastening elements, and thereby form a belt 68 of the linked fastening elements. It is noted that fastening-element structures, and linking structures, other than the structures of the fastening elements 44 and the linking arrangement thereof to form the belt 68 could be used without departing from the spirit and scope of the invention.

The structures of the fastening elements 44 and the linking arrangement of the belt 68 are similar to structures of the fastening elements and belt disclosed in U.S. Pat. No. 5,478,051, which issued on Dec. 26, 1995. U.S. Pat. No. 5,478,051, which is incorporated herein by reference thereto, corresponds to European Patent No. EP 0 506 307.

Referring to FIG. 3, a first flat plate 70 is formed with a pin 72 extending outward from one side thereof, and represents a structure with which the fastening element 44 is to be assembled. A second flat plate 74 is formed with a hole 76 which is located about the pin 72. The sleeve 58 is to be inserted into the hole 76 while the opening 60 of the sleeve is tightly positioned about the pin 72. The circular head 56 engages the second plate 74 to facilitate retention of the second plate with the first plate 70.

Figure 4:
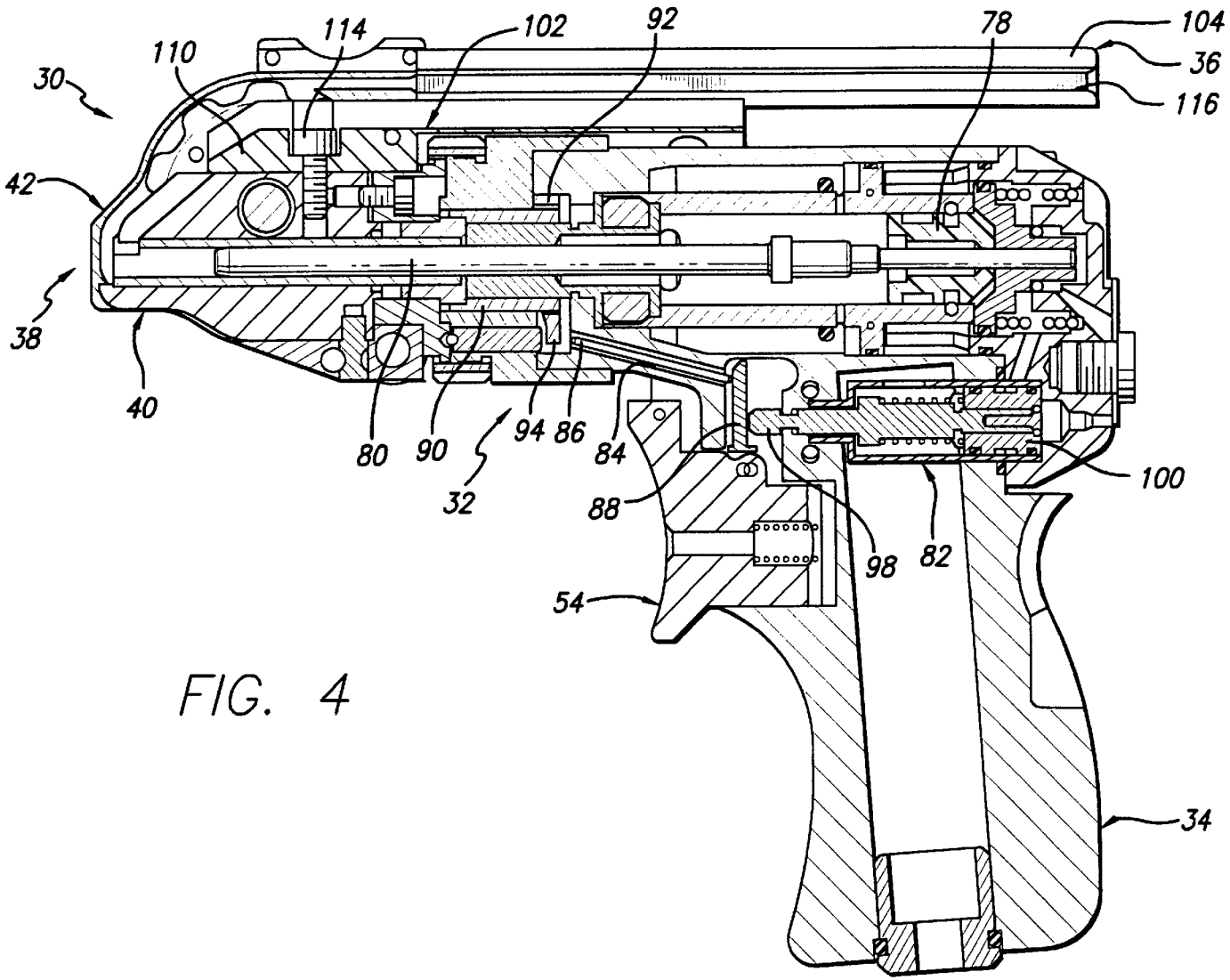
FIG. 4 is a sectional view showing the fastener device of FIG. 1 in accordance with certain principles of the invention.

As shown in FIG. 4, the housing 32 includes cylindrical elements which are arranged to provide a guideway for movement of a piston 78 and a piston rod or driver 80, the forward end of which is movable into the assembly station 38. A valve assembly 82 is located within the upper end of the handle 34 and facilitates the supply of pressurized air to move the piston 78 and the driver 80.

Figure 6:
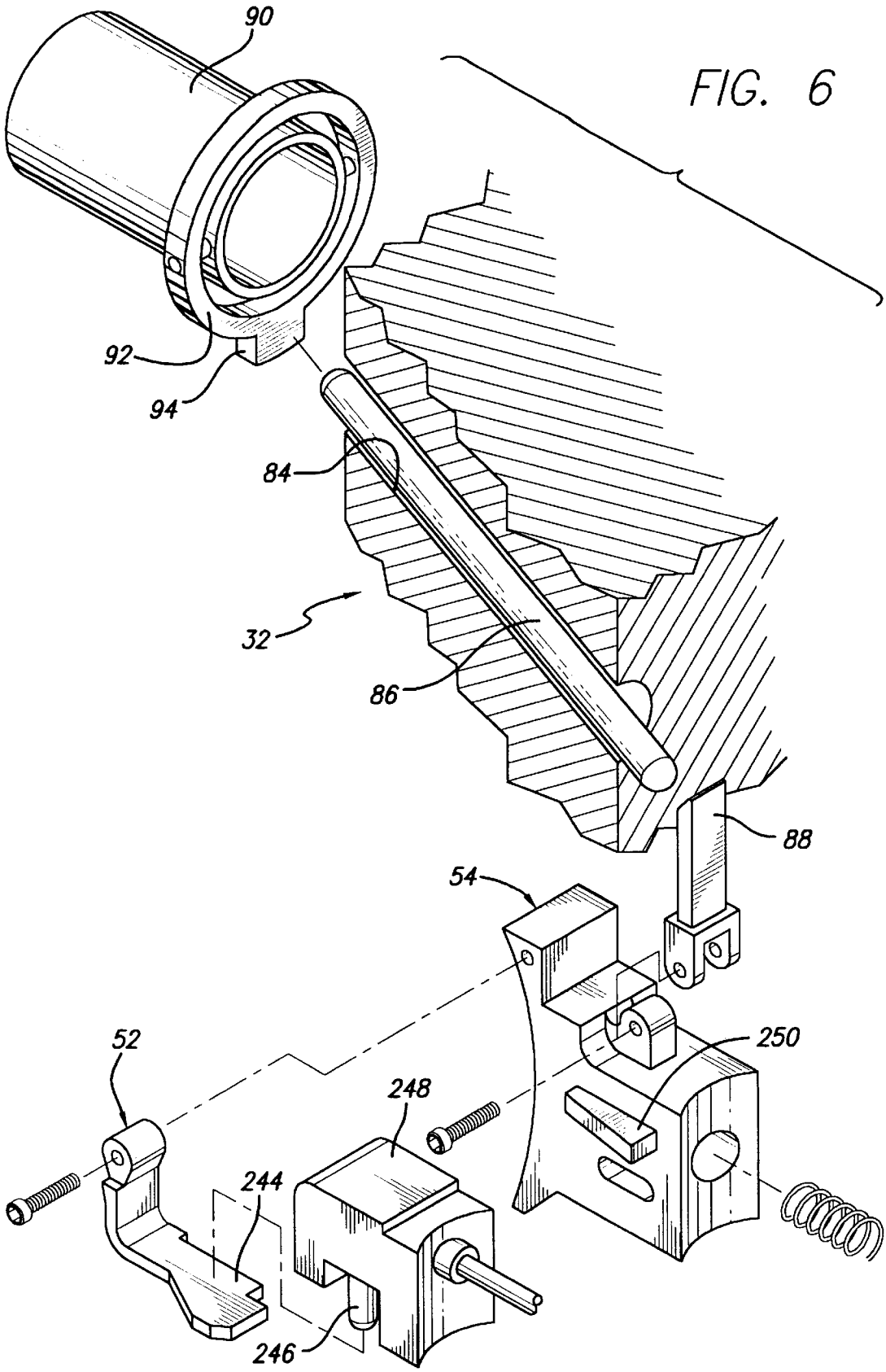
FIG. 6 is a partial exploded perspective view showing an actuating feature of the fastener device of FIG. 1 in accordance with certain principles of the invention.

Referring to FIGS. 4 and 6, the housing 32 is formed with an opening 84 which supports for movement therein a rod 86, the length of which allows the rod to extend from opposite ends of the opening. An intermediate element 88 is mounted on the actuator 54 for movement therewith and for pivotal movement relative thereto. A sleeve 90 is located axially about the driver 80 and is movable slightly in an axial direction. A ring 92, formed with a radially outward tab 94, is attached to the outer surface of the sleeve 90 for movement therewith, and for rocking movement relative thereto.

Figure 5:
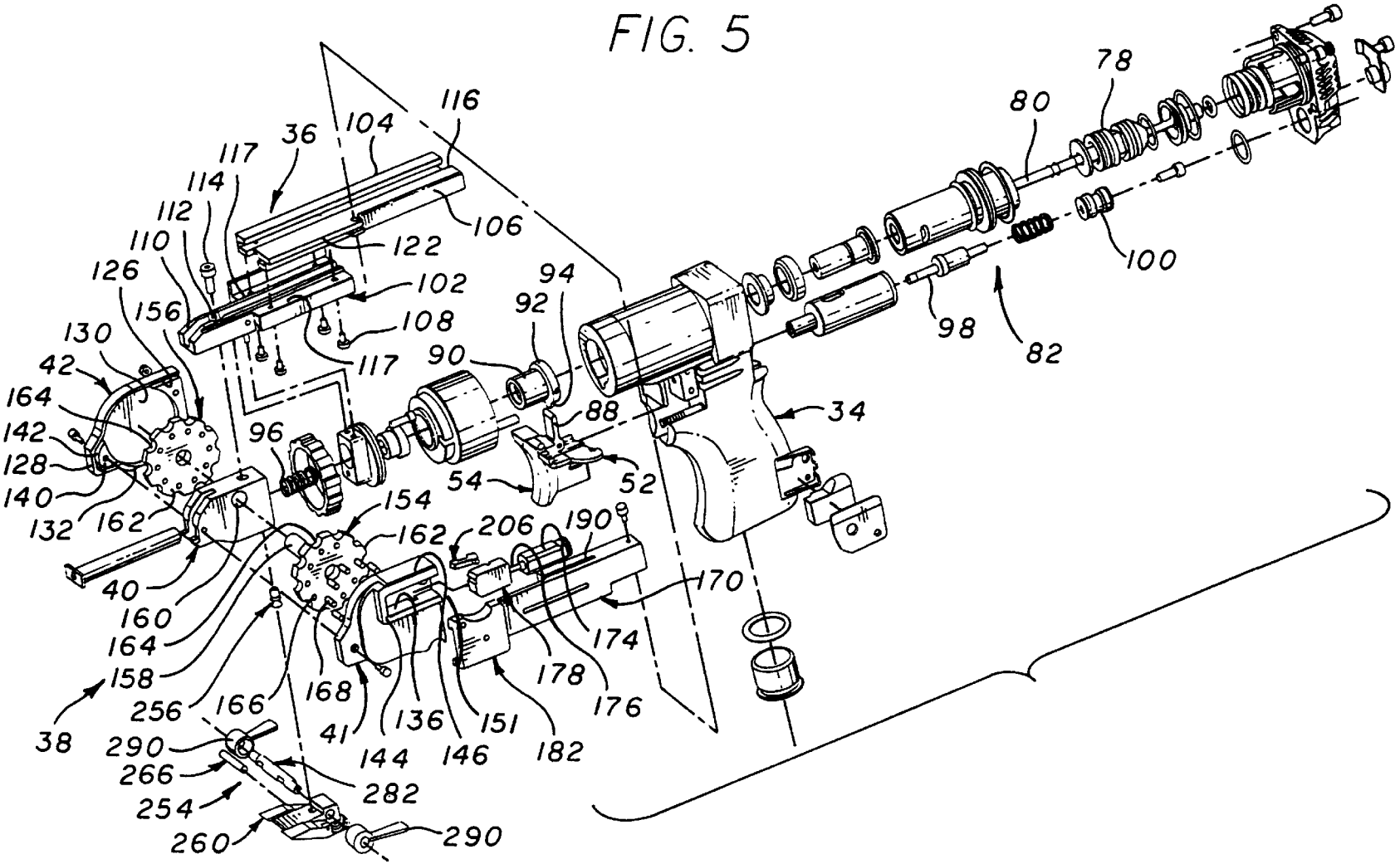
FIG. 5 is an exploded view showing selected features of the fastener device of FIG. 1 in accordance with certain principles of the invention.

In the operation of the fastening device to assemble the lead fastening element 44*a* with the structure formed by the plates 70 and 74, the forward end or nose 40 of the device is pressed against the plate 74 to compress a spring 96 (FIG. 5). This action causes the sleeve 90 to move slightly and axially toward the rear of the fastening device 30, whereby the tab 94 is located to engage a forward end of the rod 86. With the lead fastening element 44*a* in position at the assembly station 46, an operator squeezes the trigger-like actuator 54 which moves the intermediate element 88 toward a forward end of a stem 98 of the valve assembly 82.

As the intermediate element 88 engages the stem 98, there is a tendency for the intermediate element to be pivoted toward the forward end of the fastening device 30 and, thereby, not move the stem, in which instance the valve assembly 82 would not be operated. However, since the sleeve 90 has been moved slightly toward the rear of the fastening device 30 as noted above, the forward end of the rod 86 engages the tab 94 and the rear end of the rod engages an upper surface of the intermediate element 88 to buttress the intermediate element. As the actuator 54 is further squeezed by the operator, the intermediate element 88 is urged into moving engagement with the stem 98. Buttressed by the rod 86, the intermediate element 88 moves the stem 98 rearward to move a valve 100 thereby facilitate the supply of pressurized air to move the piston 78 and the driver 80 toward the forward end of the fastening device 30. With movement of the driver 80 in the forward direction, the lead fastening element 44*a* is separated from the belt 68 and pushed into assembly with the structure of the plates 70 and 74.

During the period when the actuator 54 is being squeezed, the reactive force being applied to the rear end of the rod 86, through the intermediate element 88 and the stem 98, causes the rod to urge the tab 94 toward the forward end of the fastening device 30. With this action, the ring 92 rocks slightly on the sleeve 90 to the allowable limit thereby providing a firm support for the intermediate element 88 to fully facilitate the operation of the valve assembly 82.

In the event the trigger-like actuator 54 is squeezed when the forward end of the fastening device 30 is not pressed against the structure, the intermediate element 88 is moved into engagement with the stem 98. However, the tab 94 has not been moved adjacent the forward end of the rod 86 and, therefore, does not provide support for the intermediate element 88. Upon continued squeezing of the actuator 54, the intermediate element 88 is pivoted toward the front of the fastening device 30 whereby the stem 98 is not moved and the valve assembly is not operated.

Figure 8:
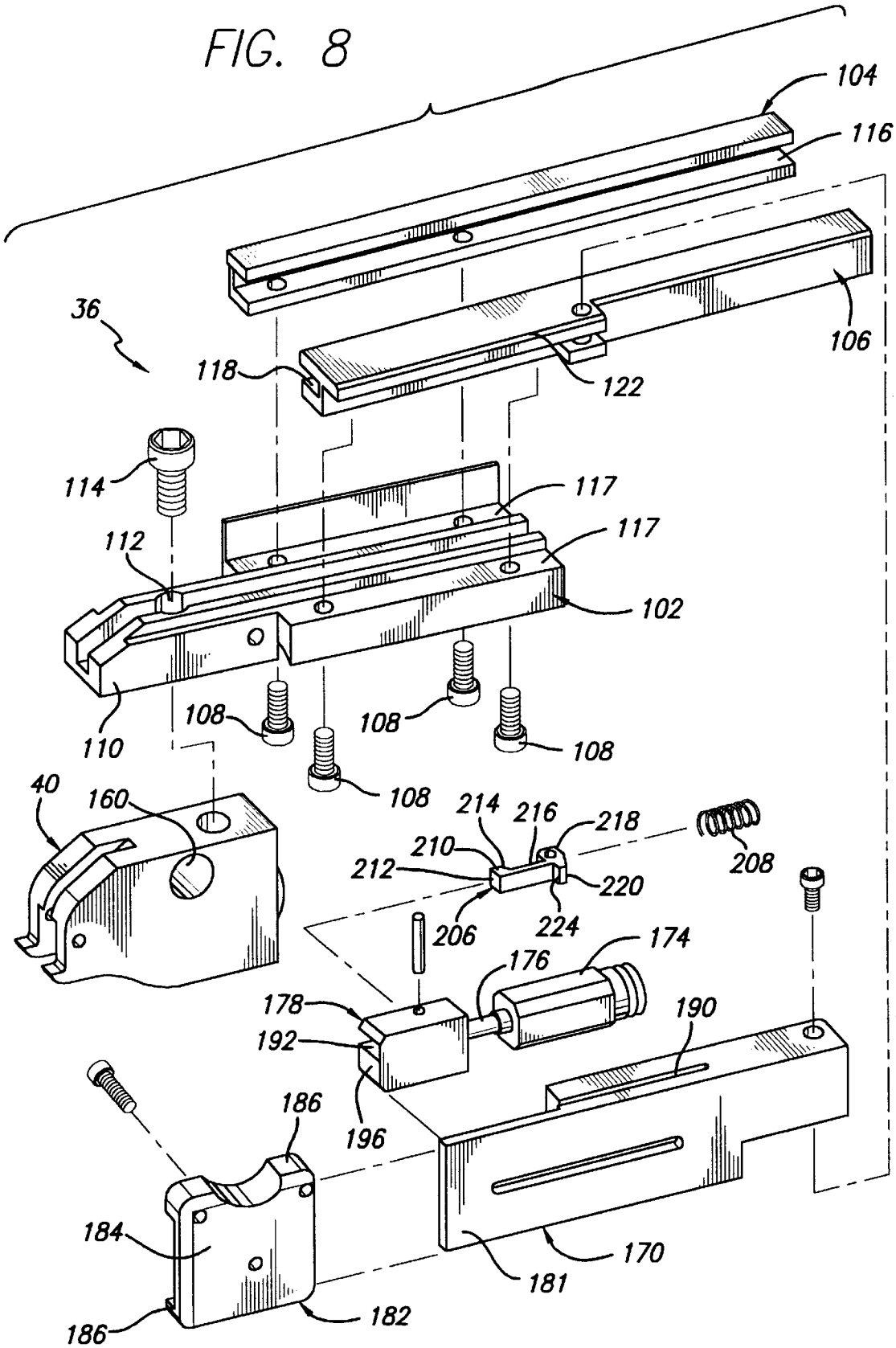
FIG. 8 is an exploded perspective view showing the magazine of FIG. 7 in position for attachment to a nose piece, and further showing a fastener-element advancing mechanism, all in accordance with certain principles of the inventor.
Figures 9, 10:
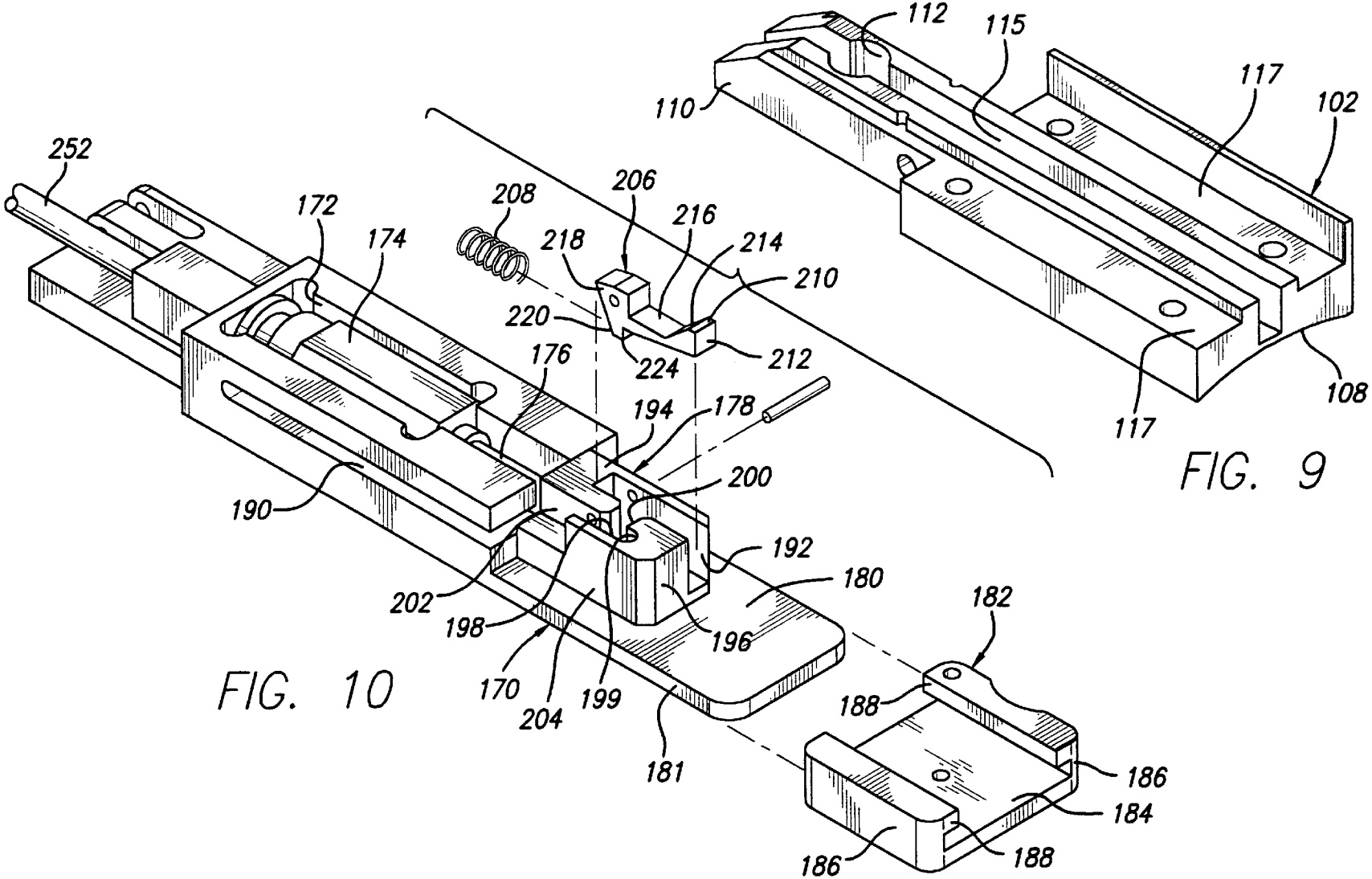
FIG. 9 is a perspective view showing a base of the magazine of FIGS. 7 and 8 in accordance with certain principles of the invention.
FIG. 10 is a perspective view showing details of the fastener-element advancing mechanism of FIG. 8 in accordance with certain principles of the invention.

As shown in FIGS. 5 and 8, the magazine 36 is formed by a base member 102 and two spaced upper rail members 104 and 106, which are secured together by four bolts 108. As shown in FIG. 9, the base member 102 is formed with a curved undersurface 108 which accommodates the positioning of the base on a surface of the housing 32 having a complementary shape. The base member 102 is also formed with a forward section 110 which is formed with a hole 112 to facilitate securance of the base, and the magazine 36, with the nose 40 by use of a bolt 114 as shown in FIGS. 5 and 8. A central clearance channel 115 is formed in the base member 102 to provide clearance for any portions of the fastening elements 44 which may extend therein. Recessed shelves 117 are formed on the base member 102 to provide defined locations for receipt of lower portions of the rail members 104 and 106.

The rail members 104 and 106 are formed with channels 116 and 118, respectively, which face each other on opposite sides of a space therebetween to define a track 120 (FIG. 1), into which the fastening elements 44 are loaded and from which the fastening elements are conveyed to the assembly station 46. The rail member 106 is formed with a shelf 122 which overhangs from an upper side edge along a forward half thereof.

Figure 13:
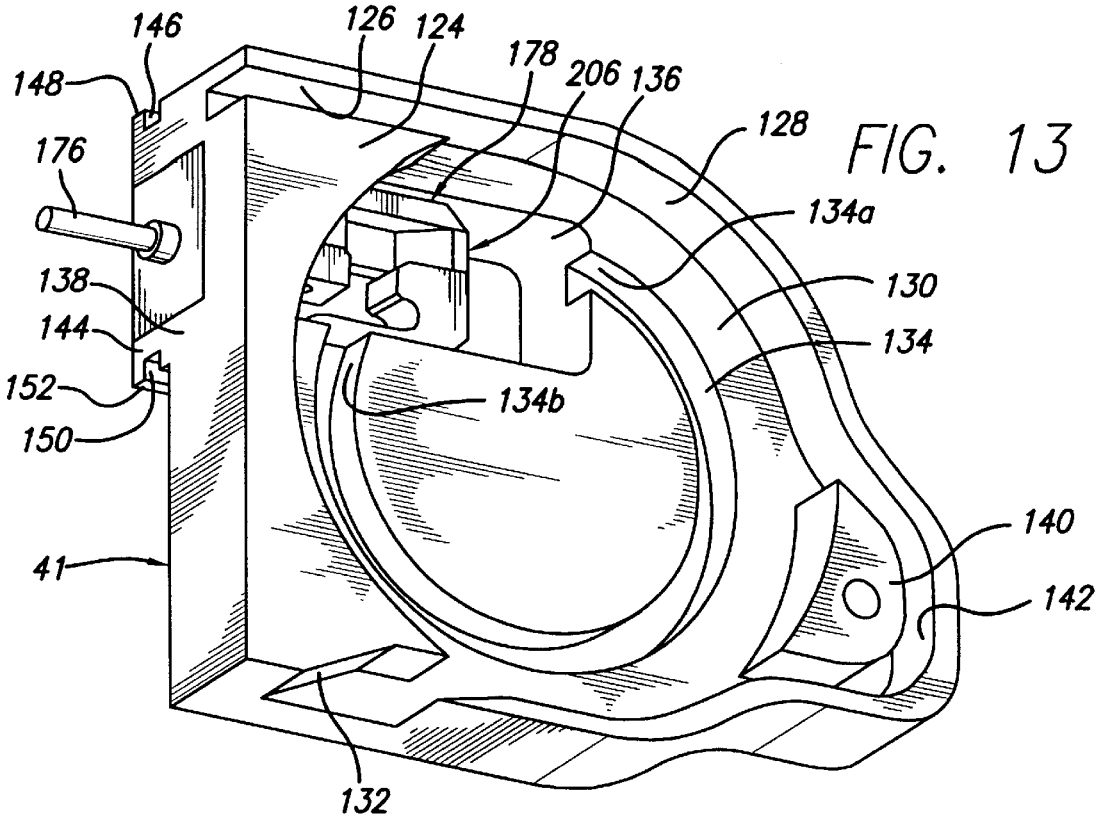
FIG. 13 is a perspective view showing a guide plate for the fastener elements in assembly with the advancing mechanism of FIG. 8 in one position in accordance with certain principles of the invention.
Figure 14:
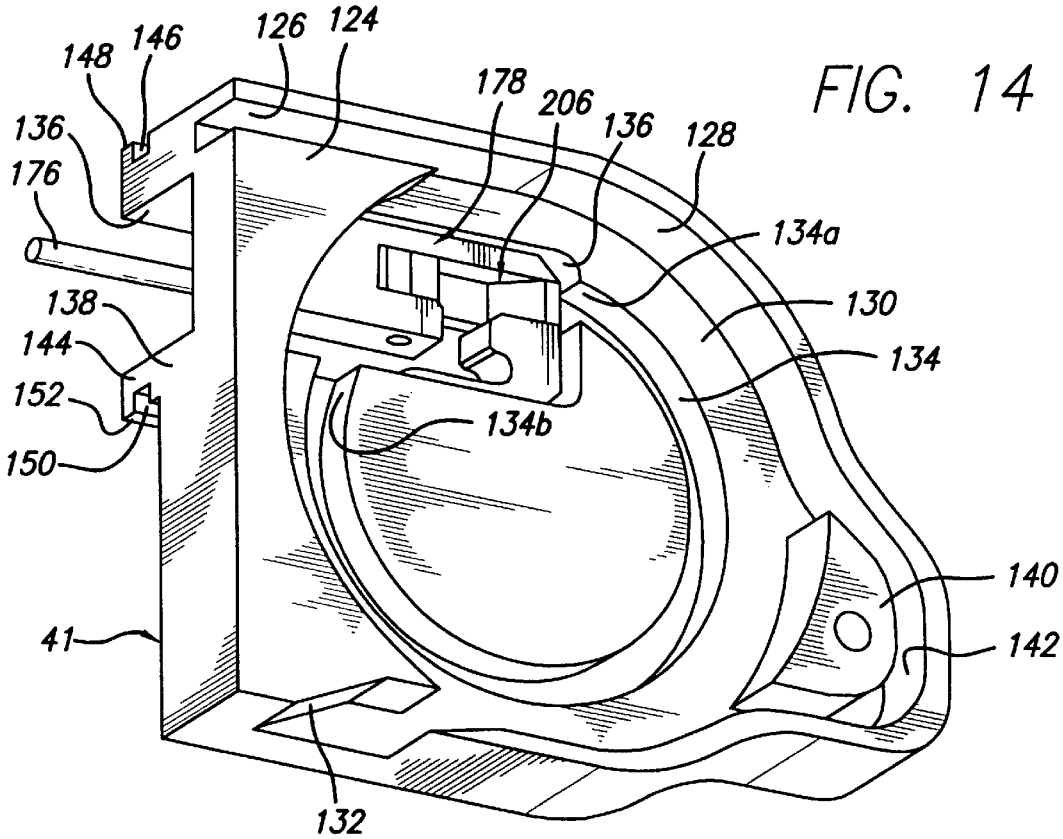
FIG. 14 is a perspective view showing the guide plate of FIG. 13 in assembly with the advancing mechanism of FIG. 8 in another position in accordance with certain principles of the invention.

Referring to FIGS. 13 and 14, the guide plate 41 is formed on an inboard side 124 thereof with an entry channel 126 and a guide wall 128 which is contiguous with a floor surface 130. The wall 128 defines essentially the path to be followed by the guide elements 64 (FIG. 2) and the monofilaments 66 of the belt 68 as the fastening elements 44 are being advanced to the assembly station 46. An exit channel 132 is formed in the guide wall 128 to provide an exit path for the guide elements 64 and the monofilaments 66 after the successive lead fastening elements 44*a* have been separated therefrom. A generally circular track or groove 134 is formed on the floor surface 130, with spaced ends thereof being separated by a generally rectangular opening or recess 136 which extends through a rear surface 138 of the plate 41.

A guide block 140 extends outward from the floor surface 130 and provides a guide channel 142 between the wall portions thereof and the adjacent portions of the wall 128. The guide channel 142 provides an enhanced locator for the lead fastening element 44*a* and the adjacent guide element 64 and the monofilaments 66. This insures accurate locating of the lead fastening element 44*a*, and supporting of the guide elements 64 and monofilaments 66, during the separating of the lead fastening element from the belt 68. The guide plate 41 is formed with an extended outboard side wall 144 (FIG. 5) which is formed with a groove 146 in a top surface 148 thereof and a groove 150 in a bottom surface 152 thereof. The side wall 144 provides a defined frame for the opening 136, with an entry port 151 at a rear thereof as shown in FIG. 5.

Referring to FIG. 5, the guide plate 42 also is formed with the entry channel 126, the guide wall 128, the floor surface 130, the exit channel 132, the guide block 140 and the guide channel 142. However, the guide plate 42 is not formed with the circular track 134, the opening 136, the side wall 144 and the grooves 146 and 150.

A fastener-element advance unit includes a generally circular drive disc, or support element, 154 and a generally circular follower disc 156 located on opposite sides of the nose 40. The discs 154 and 156 rotate together by being keyed to a common shaft 158 which extends through an opening 160 formed through the nose 40. Each of the discs 154 and 156 are formed on the peripheral edge thereof with a plurality of sprockets 162, with spaces 164 formed between adjacent pairs of the sprockets. During a conveying or advancing operation of the belt 68, those guide elements 64 of the belt, which are within the plates 41 and 42, are located within respective ones of the spaces 164 between the sprockets 162. As the discs 154 and 156 are incrementally rotated, in a manner described hereinafter, the guide elements 64 are advanced whereby the respective fastening elements 44 of the belt 68 are also advanced. A conveying mechanism for the fastening device 30 includes the discs 154 and 156, and the elements which facilitate rotation of the discs.

Figure 15:
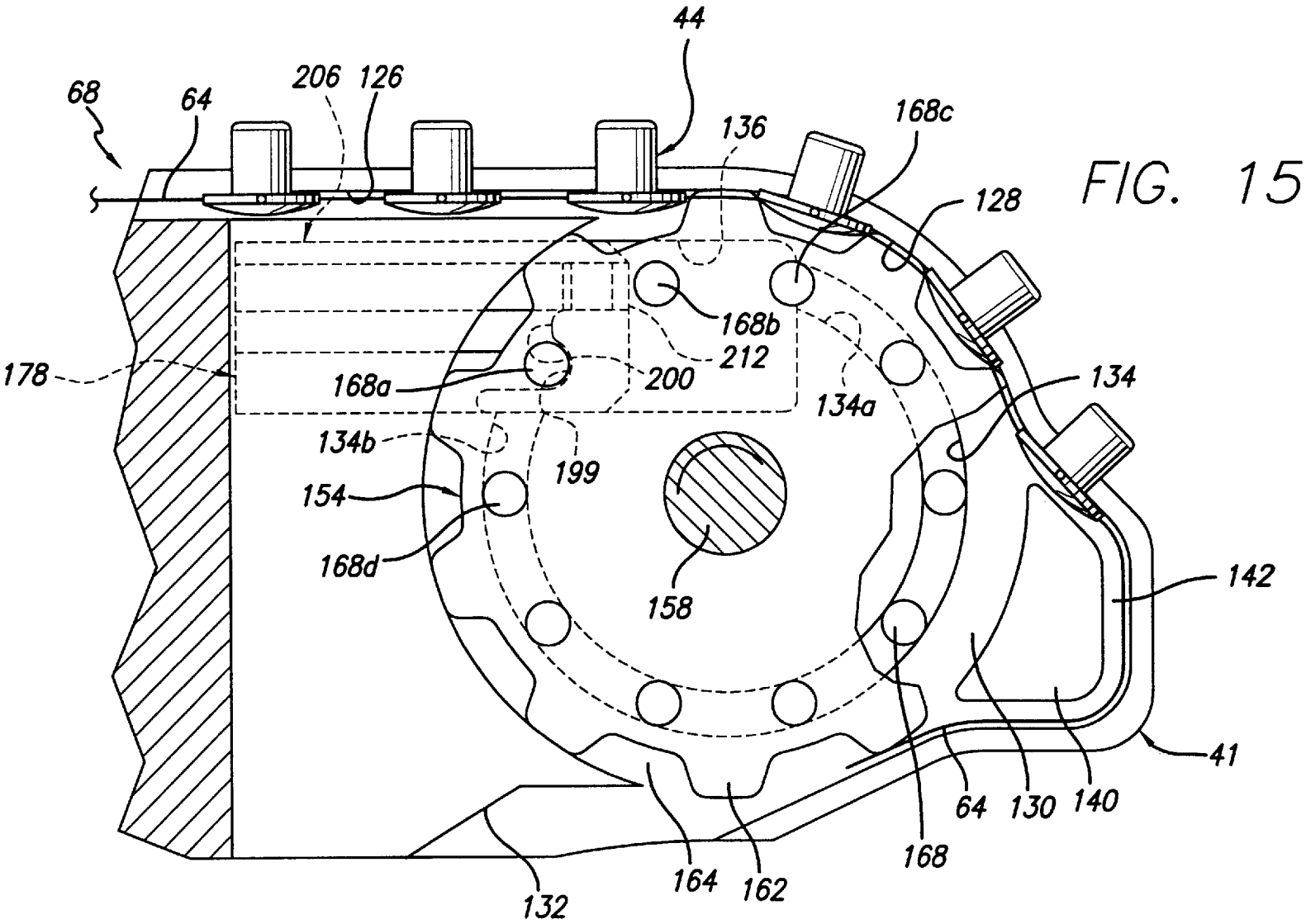
FIG. 15 is a side view of a forward end of the fastener device of FIG. 1 with portions removed to show the serially-held fastener elements in a first position relative to a portion of the advancing mechanism of FIG. 8, all in accordance with certain principles of the invention.
Figure 16:
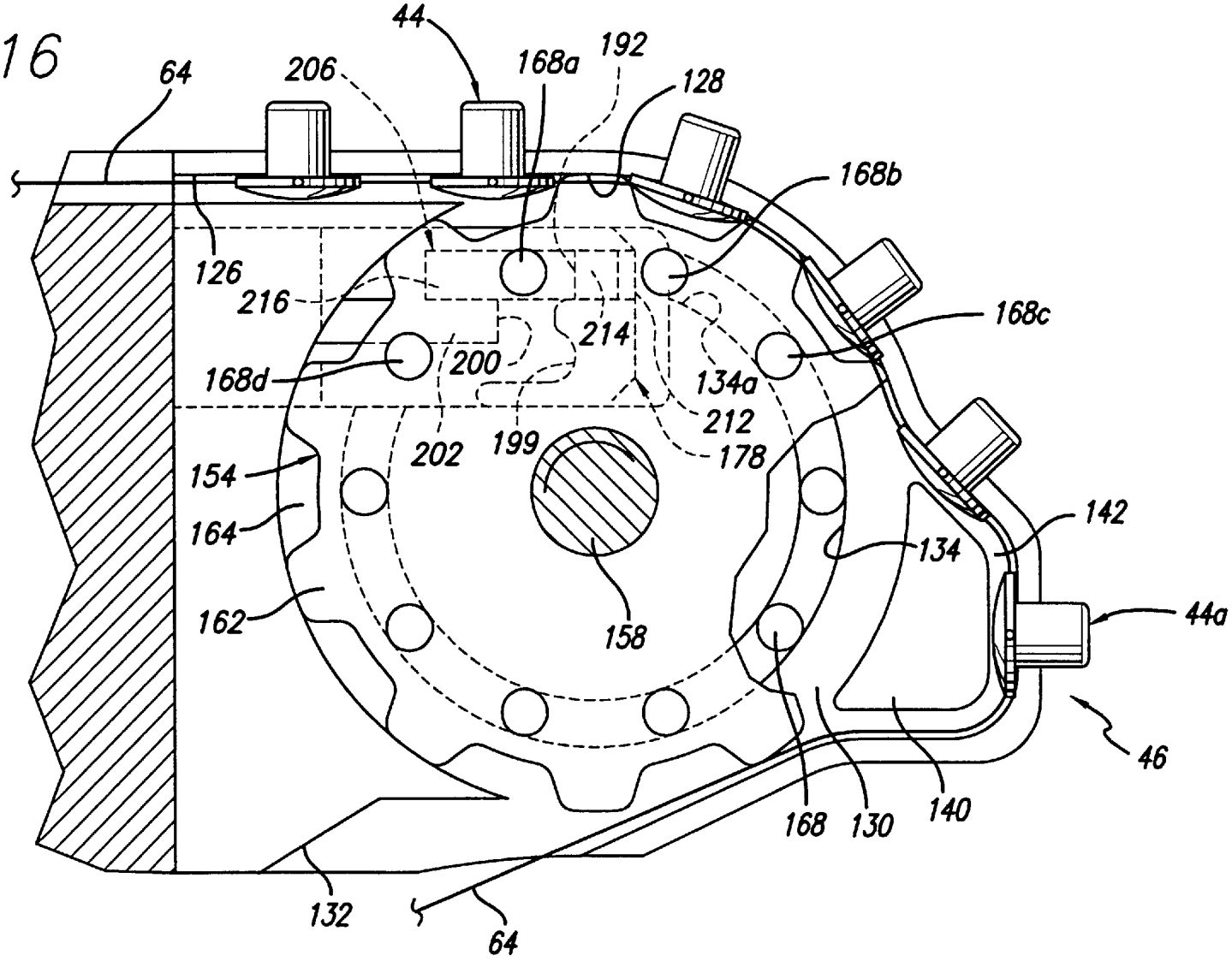
FIG. 16 is a side view, similar to the side view of FIG. 15, showing the forward end of the fastener device of FIG. 1 with portions removed to show the serially-held fastener elements in a second position relative to the portion of the advancing mechanism of FIG. 8, all in accordance with certain principles of the invention.

The drive disc 154 is formed with a plurality of through holes 166 for receipt of a corresponding plurality of pins or projections 168. In assembly, the discs 154 and 156 are located within the guide plates 41 and 42, respectively, and are adjacent and face the floor surfaces 130 of the respective plates. In this assembled relation, the pins 168 extend into the circular track 134 as illustrated in FIGS. 15 and 16.

As shown in FIGS. 8 and 10, a support plate 170 is mounted for pivotal movement to one end of the shelf 122 of the rail member 106. The inboard side of the plate 170 is formed with a nest 172 for receipt of an air cylinder 174, having a piston rod 176 extending from one end thereof. The forward end of the piston rod 176 is attached to a rear end of a carrier element 178 which is slidable over an inboard surface 180 of a forward end 181 of the plate 170. A locking slide 182 is formed with a major flat section 184, up-turned side walls 186 on opposite sides thereof, and inwardly turned mating sections 188. The slide 182 is placed over the forward end 181 of the plate 170 and eventually is positioned with the mating sections 188 being located within grooves 190 formed in exterior side walls on opposite sides of the nest 172.

As shown in FIGS. 11 and 12, the carrier element 178 is formed with a deep socket or first channel 192 in a top surface 194 and a forward surface 196. A second channel 198 is formed in the top surface 194, and is parallel with, and spaced from, the first channel 192. The second channel 198 includes a forward dead-end section 199 with a rounded forward wall, which forms a backward blocking member. A communicating channel 200 formed in the top surface 194 provides a communicating link between the first and second channels 192 and 198. A large notch 202 is formed in the top surface 194 and a side surface 204 in a rear corner of the carrier element 178, and is aligned, and in communication, with the second channel 198.

An advance element 206 is mounted for within the first channel 192 of the carrier element 178, for movement therewith and for pivotal movement relative thereto. As shown in FIG. 12, a spring 208 urges the advance element 206 generally to the position shown therein in a counterclockwise direction. The advance element 206 is formed with a catch 210 which includes a forward end face 212 and a rearward ramp or sliding face 214. A substantially planar surface 216 is formed on the advance element 206 and is contiguous with the sliding face 214. The advance element 206 is also formed with a stud or pin holder 218 to facilitate the mounting of the advance element with the carrier element 178.

The advance element 206 is further formed with a lower rear region 220 which is shaped to engage a floor surface 222 of the first channel 192 to generally prevent the advance element from pivoting any further in the counterclockwise direction than that shown in FIG. 12. An undersurface portion 224 of the advance element 206 which are immediately forward of the region 220 is curved to allow the advance element to pivot in a clockwise direction within the first channel 192.

Figure 7:
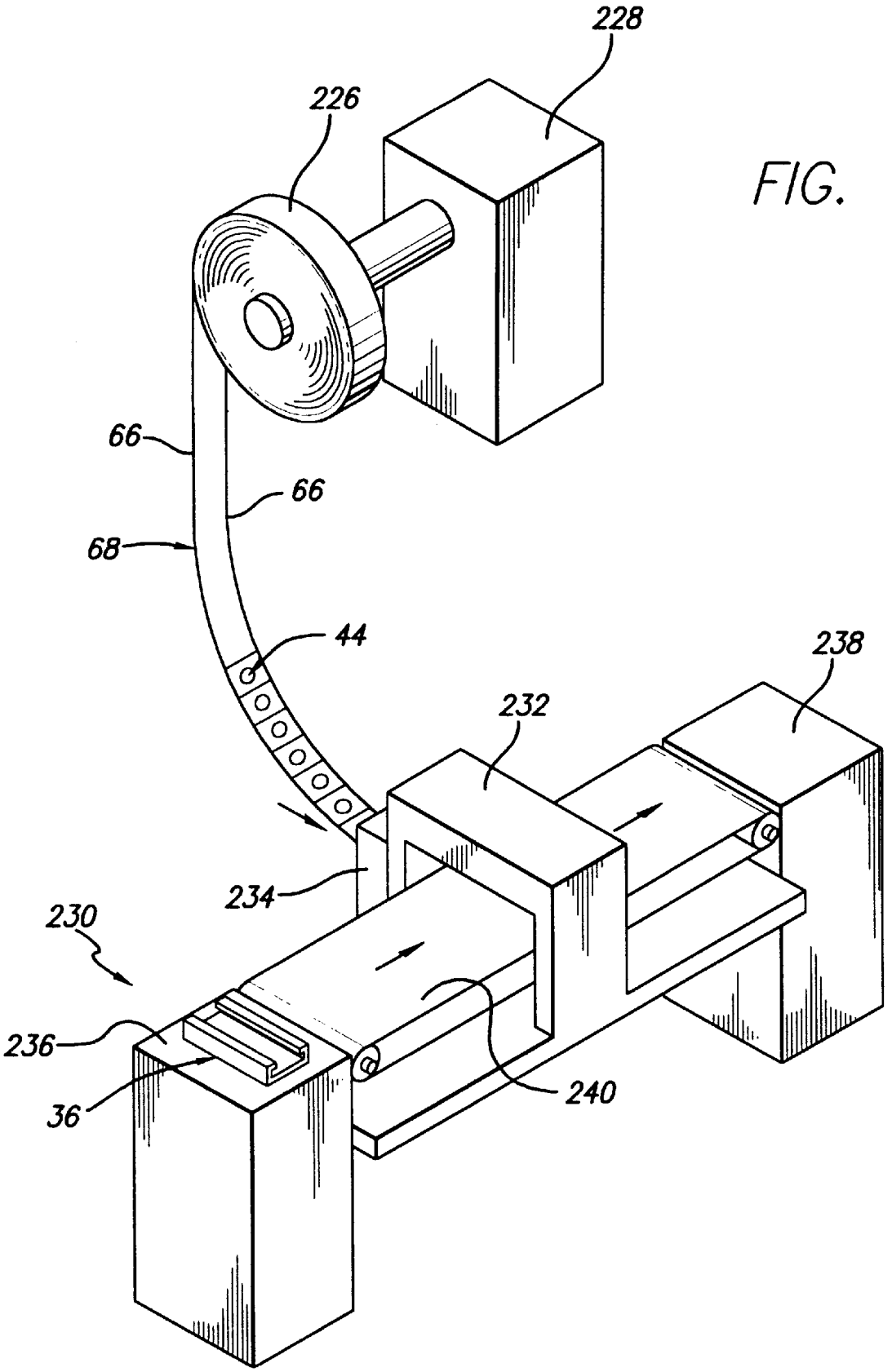
FIG. 7 is a perspective diagrammatical view showing a system for feeding the fastener elements of FIG. 2 into a loading station whereat the elements are loaded into a magazine in accordance with certain principals of the invention.

Referring now to FIG. 7, the belt 68 of the fastening elements 44 is wound onto a reel or storage container 226 which is mounted on a stand 228 for rotation relative thereto. An apparatus 230 for assembling sections of the belt 68 of fastening elements 44 with the magazine 36 includes a workstation or fastening-element loading station 232 which includes a first conveyor arrangement 234 for feeding the belt 68 into the workstation. The apparatus 230 further includes a magazine feed or loading station 236 and a magazine removal or unloading station 238. A second conveyor arrangement 240 conveys a respective magazine 36 from the magazine loading station 236 to the workstation 232.

The magazine 36 is positioned in a predetermined location in the workstation 232. The first conveyor arrangement 234 is then activated to feed a predetermined number of the fastening elements 44 of a leading portion of the belt 68 into the magazine 36. The monofilaments 66 are then selectively severed so that the lead portion of the belt 68, which is now in the magazine 36, is separated from the trailing portion of the belt extending from the storage container 226. The second conveyor arrangement 240 is operated to move the loaded magazine 36 to the unloading station 238 where the loaded magazine is removed from the apparatus 230 for assembly with the other components of the fastening device 30.

As shown in FIG. 1, the loaded magazine 36 is assembled with the other components of the fastening device 30 by locating the curved undersurface 108 (FIG. 9) onto a curved band or magazine holder 242. The bolt 114 is then threadedly attached to the nose 40 as described above to secure the loaded magazine 36 in its operating position as a component of the fastening device 30. The belt 68 may be moved forward slightly to place at least the lead fastening element 44*a* into the entry channel 126 and partially adjacent the guide wall 128, so that the lead guide elements 64 are properly aligned with the drive disc 154 to effect conveyance of the fastening elements 44 when the disc is incrementally stepped.

Figure 21:
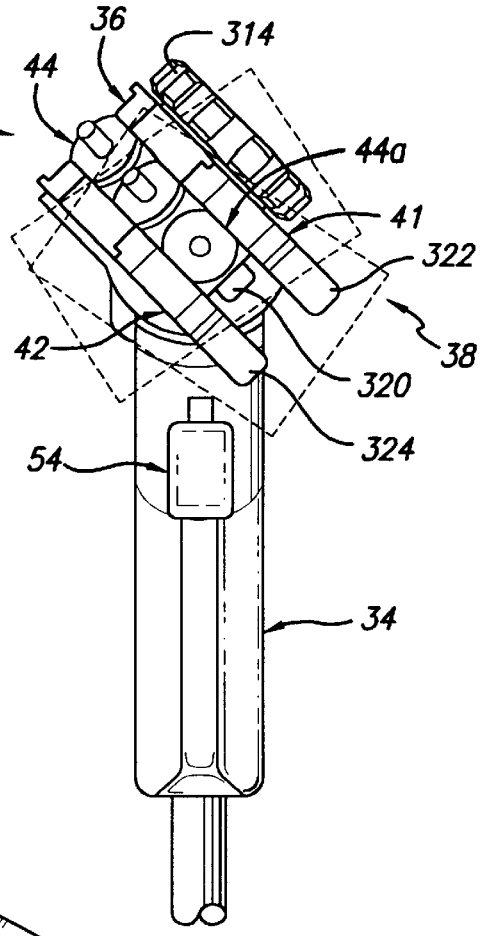
FIG. 21 is a perspective view showing a front of the fastening device of FIG. 19 with a central body, a magazine and a nose portion thereof being tiltable to several positions, and illustrative of the tiltability of the same components of the preferred fastening device of FIG. 1, all in accordance with certain principle invention.
Figure 22:
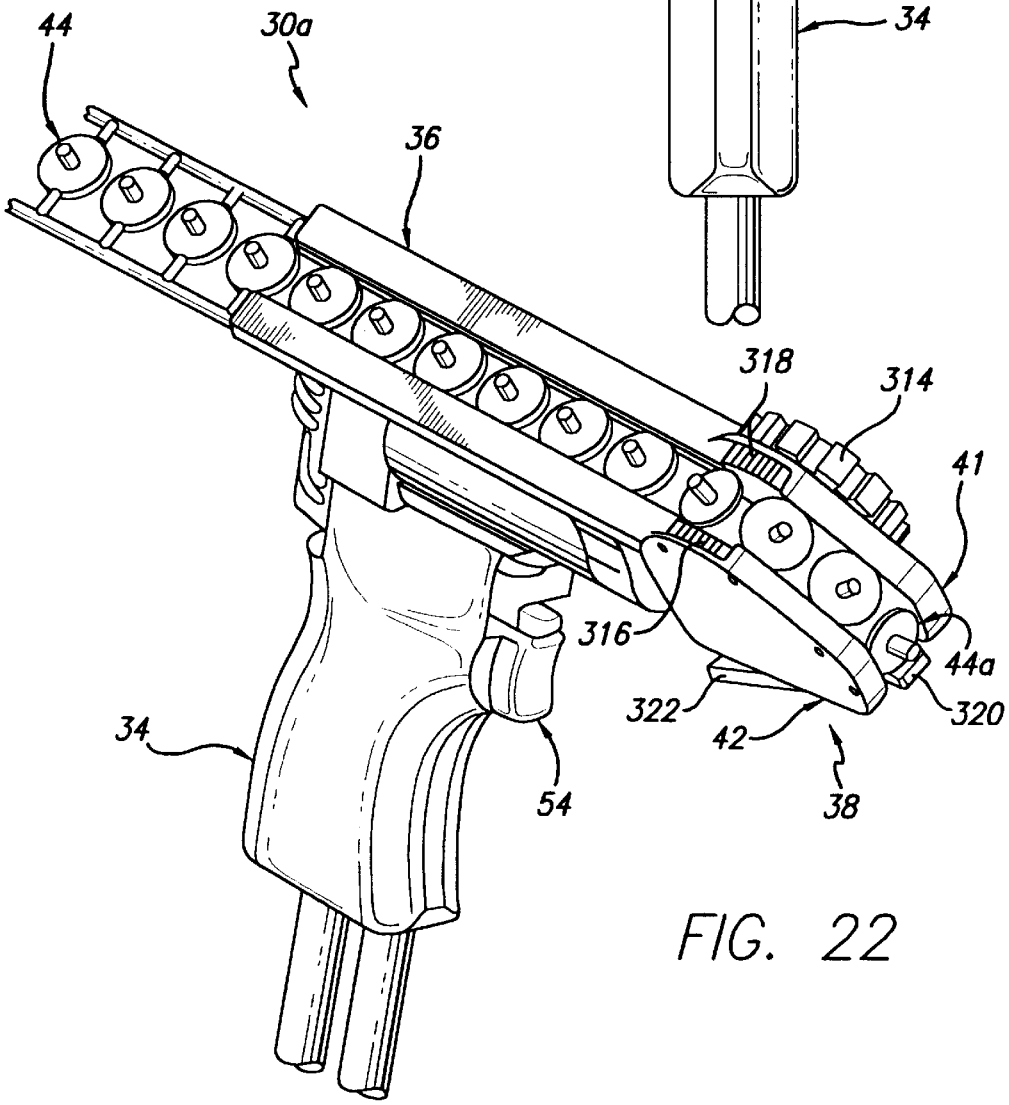
FIG. 22 is a perspective view showing the right side and top of the fastening device of FIG. 19, with the central body, the magazine and the nose portion thereof tilted to the right side of the fastening device in accordance with certain aspects of the invention.

The nose 40 can be moved relative to the band 242 for a limited distance in a rotational direction about its axis. For example, the nose 40 can be moved, or partially rotated, in a clockwise or counterclockwise direction from the upright position illustrated in FIG. 1, within a span of two-hundred and fifty degrees from a clockwise limit to a counterclockwise limit. This tilting feature is illustrated in FIGS. 21 and 22 with respect to a fastening device 30*a* which is a second embodiment of the invention, and provides versatility in the use of the fastening devices 30 and 30*a* in the placement of the devices against structures formed with limited access thereto.

The locking slide 182 is moved into the slots 190 of the support plate 170 which is pivotally attached to the magazine 36, as noted above. The slide 182 is then swung or pivoted toward the adjacent guide plate 41 with the carrier element 178 being moved into the opening 136 of the guide plate, as viewed in FIG. 13. Thereafter, the locking slide 182 is moved in a forward direction of the fastening device 30 so that the mating sections 188 of the slide are moved into the grooves 146 and 150 of the guide plate 41 to thereby lock the support plate 170 in the described position with the carriage element 178 firmly located within the opening 136.

Referring again to FIG. 15, prior to swinging the support plate 170 into the position as described above, the drive disc 154 may require adjustment to insure that the pin 168*a* is properly located for positioning within the dead-end section 199 of the carriage element 178. With the drive disc 154 being in this position, the pin 168*b* will be located immediately forward of the forward face 196 of the advance element 206, the pin 168*c* is located at an entry end 134*a* of the circular track 134, and the pin 168*d* is located within the track near an exit end 134*b* thereof.

It is noted that, when the carrier element 178 is in the retracted position of FIG. 15, a side wall 225 of the element functions as a blocking section to cover the exit end 134*b* of the track 134.

As shown in FIG. 6, the lever arm 52 is formed with a paddle 244 which is positioned adjacent a plunger 246 of an air switch 248, and which normally rests on a ledge 250 extending from the actuator 54. The switch 248 is connected to power line 50 which facilitates the supply of pressurized air thereto. An air conduit 252 (FIG. 10) is attached at one end thereof to an exit side of the switch 248, and to an entry side of the air cylinder 174.

When an operator wishes to advance the belt 68 within the magazine 36 and the head 38, the operator manipulates the lever arm 52 to facilitate the supply of pressurized air to the air cylinder 174, whereby the carriage element 178 is moved forward within the opening 136 from the position illustrated in phantom in FIG. 15 to the position illustrated in phantom in FIG. 16. As the carriage element 178 is moved forward from the position illustrated in FIG. 15, the end face 212 of the advance element 206 engages the pin 168*b* and moves the pin to the position illustrated in FIG. 16 at the entry end 134*a* of the track 134.

Since the pins 168 are attached to the drive disc 154, the drive disc is moved whereby the sprockets 162 and the spaces 164 facilitate movement of the guide elements 64, and thereby provide conveying movement of the fastening elements 44 from the magazine 36. As the driver disc 154 is being moved, the pin 168*c* moves in a clockwise direction within the track 134 to the position illustrated in FIG. 16. Also, the location of the channel 200 is designed so that, upon simultaneous movement of the carriage element 178 and the pin 168*a*, the pin passes through the channel 200 into the channel 192 rearward of the sliding face 214.

Upon the return stroke of air cylinder 174, the carriage element 178 is retracted whereby the pin 168*a* engages the retracting sliding face 214 and urges the advance element 206 downward against the biasing action of the spring 208. As the carriage element 178 is fully retracted to the position shown in FIG. 15, the pin 168*a* clears the advance element 206 and the pin locates in the position formerly occupied by the pin 168*b* as shown in FIG. 15.

During the period when the carriage element 178 is being moved forward from the position shown in FIG. 15, and the pin 168*b* is being pushed by the advance element 206, the pin 168*d* is being moved past an exit end 134*b* of the track 134 and into the notch 202 and in alignment with the dead-end section 199. When the carriage element 178 is retracted, the section 199 is moved about the pin 168*b*, which now occupies the position formerly occupied by the pin 168*a* as shown in FIG. 15.

The operator can continue to manipulate the lever arm 52 to advance the lead fastening element 44*a* to the assembly station 46 as shown in FIG. 16. At this time, the operator presses the forward end of the fastening device 30 against the structure which will receive the lead fastening element 44*a*, and then squeeze the trigger-like actuator 54 to operate the driver 80. As the driver 80 engages the lead fastening element 44*a* and continues to move forward, the element is separated from belt 168 and is driven into secure assembly with the structure as described above.

With the trigger-like actuator 54 and the lever arm 52 being located as illustrated in FIG. 1, the operator could manipulate the lever arm with the thumb of one hand, and the actuator with the index finger of the same hand, while gripping the handle 34 with the same hand. Further, even though the actuator 54 and the lever arm 52 are in close assembly, and to some extent movable together, the operation of the driver 80 is selective and independent of the operation of the conveying mechanism, or conveying arrangement, which includes the carriage element 178, the advance element 206, the drive disc 154 and the pins 168. Likewise, the operation of the conveying mechanism is selective and independent of the operation of the driver 80.

Figures 17, 18:
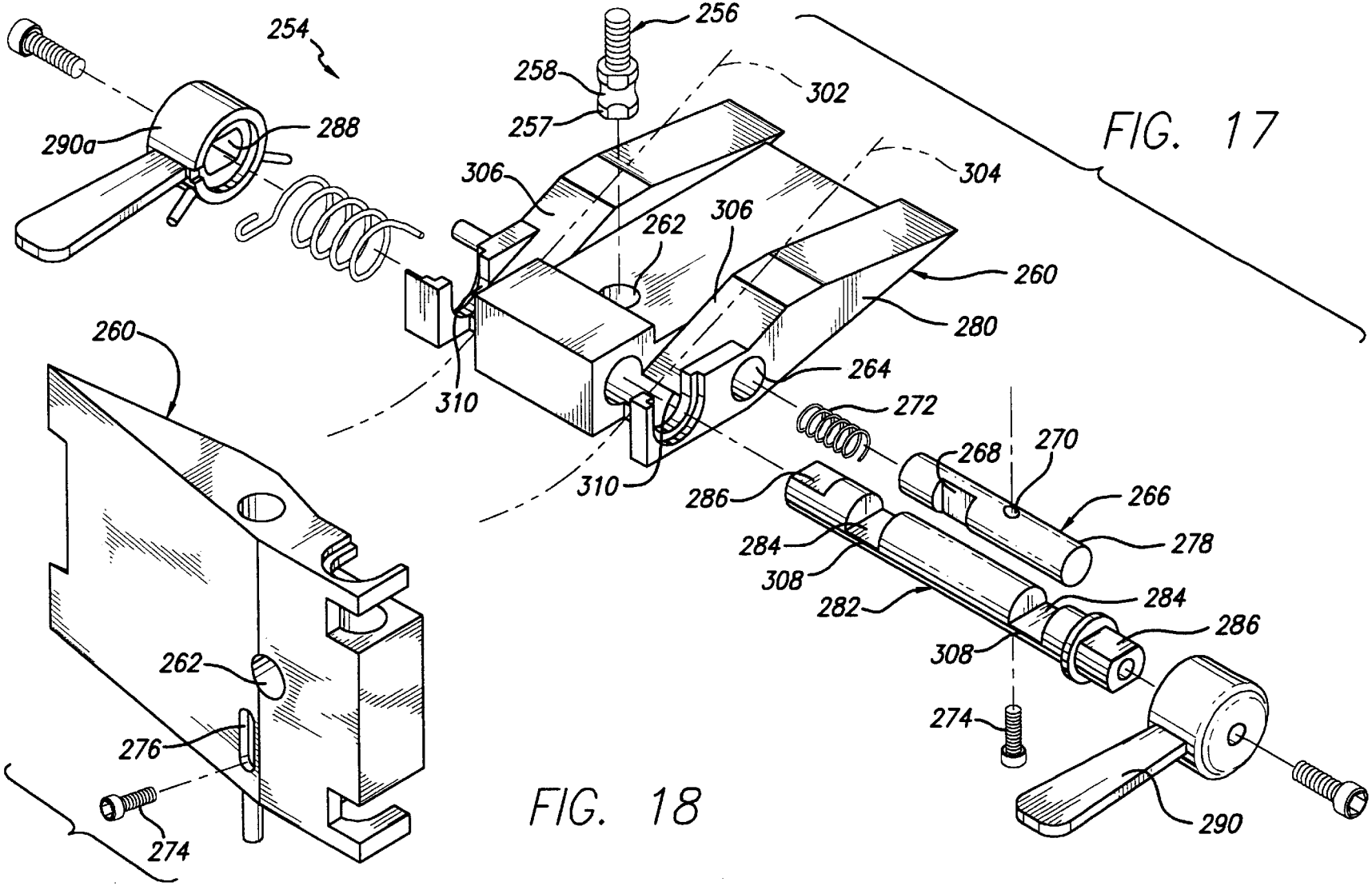
FIG. 17 is an exploded perspective view showing a monofilament separator located at the forward end of the fastener device of FIG. 1 in accordance with certain principles of the invention.
FIG. 18 is a perspective view showing a portion of the monofilament separator of FIG. 17 in accordance with certain principles of the invention.
Figure 19:
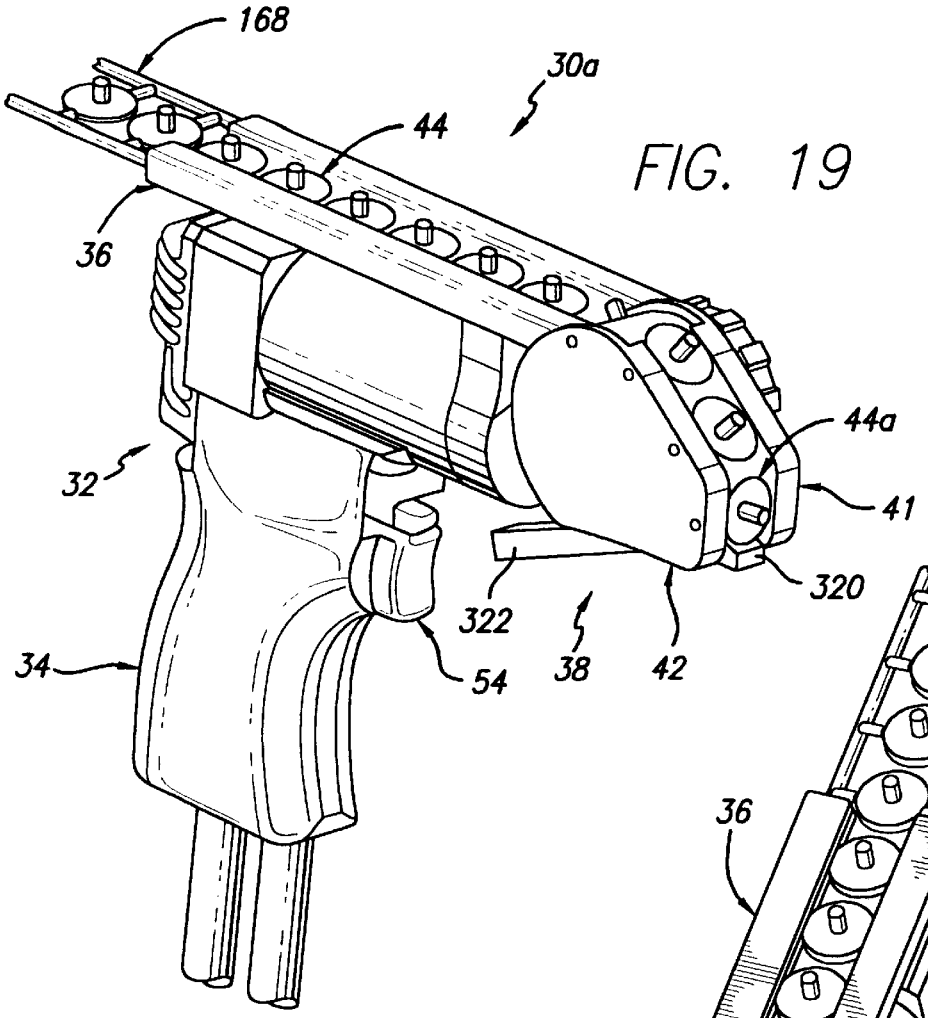
FIG. 19 is a perspective view showing generally a right side of a second embodiment of a fastening device in accordance with certain principles of the invention.
Figure 20:
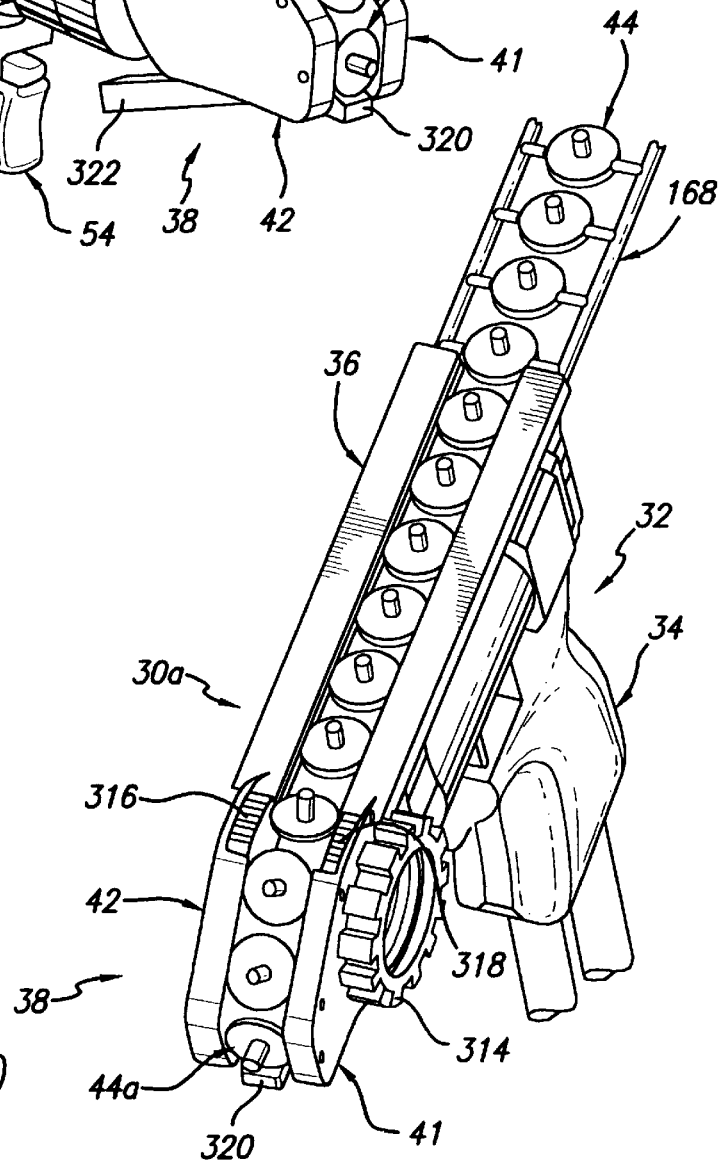
FIG. 20 is a perspective view showing generally a top of the fastening device of the FIG. 19 in accordance with certain principles of the invention.

As shown in FIG. 17, a separator 254 forms a component of the fastening device 30 and receives the residue of the guide elements 64 and the monofilaments 66 exiting through the exit channel 132 of the end plates 41 and 42 for separation thereof from the trailing portions of the belt 168 which remains within the magazine 36 and the head 38.

The separator 254 includes a mounting element 256 having threads at one end and a large head section 257 at the non-threaded end thereof with a reduced neck section 258 axially inboard of the head section. The mounting element 256 is threadedly fastened to the underside of the nose 40 in the manner illustrated in FIG. 5 with the neck section 258 being located below the nose. A guide body 260 is formed from top to bottom with a central opening 262 therethrough which communicates with a cylindrical passage 264 formed through one side thereof. A locking pin 266 is formed with a notch 268 and a threaded hole 270 and is positioned within the passage 264 behind a spring 272. A screw 274 is positioned through a slot 276 (FIG. 18) formed in the body 260 and into the threaded hole 270 of the pin 266 to retain the pin within the passage 264. One end 278 of the pin 266 normally extends outward from a side surface 280 of the body 260.

When the end 278 is pressed to move the pin 266 further into the passage 264 against the biasing action of the spring 272, the notch 268 aligns with the opening 262. The head 257 can then be moved into the opening 262 to locate the reduced neck section 258 in alignment with the round exterior surface of the pin 266. When the pin 266 is released, the pin is urged outward of the passage 264 within the limit imposed by the slot 276 and the screw 274. As the pin 266 moves outward, the notch 268 moves away from, and a round section of the pin moves into, the neck section 258 to facilitate locking attachment of the body 260 to the underside of the nose 40. The body 260 can be removed from assembly with the nose 40 by following a reverse procedure.

A cutter pin 282 is formed with a pair of spaced cutting notches 284 which extend beyond the axis of the pin, and with specially configured ends 286 which are complementary with openings 288 formed in paddle levers 290. In assembly, the notches 284 of the pin 282 are facing generally downward, but are shown in an upward position in FIG. 17 for illustration purposes only. The pin 282 is located centrally within a passage 292 formed in the body 269, with the notches 284 facing downward, and is located by a flange 294 on the pin and a bearing wall 296 formed on the body 260. A spring 298 is positioned axially about the pin 282 and between the lever 290*a* and the adjacent portion of the body 260. The levers 290 are secured to the ends 286 of the pin 282 by screws 300. The levers 290 are retained in the positioned illustrated in FIGS. 1 and 17 and either or both of the levers can be manipulated to rotate the cutter pin 282.

The paths of the guide elements 64 and the monofilaments 66 extends from channel 132 of the guide plates 41 and 42 into the body 260 and are represented in FIG. 17 by dashed lines 302 and 304. The guide elements 64 and monofilaments 66 are guided over ramps 306 of the body 260 and into spaces at the bottom of the ramps, which are formed by the overhead, or base, of the reoriented notches 284. After a selected length of the guide elements 64 and the monofilaments 66 have passed through the spaces, the paddle levers are manipulated to move an edge 308 of each notch 284 past an edge 310 at the base of each of the ramps 306. With this action, the portions of the guide elements 64 and the monofilaments 66 which are located in the path of the edges 308 and 310 are severed from the trailing portions thereof. In this manner, the scrap or residue portions of the guide elements 64 and monofilaments 66 can be efficiently captured and removed from the vicinity of the fastening device 30.

Referring to FIGS. 19 through 22, the second embodiment of the fastening device 30*a* is similar to the first embodiment of the fastening device 30 as described above. Only those components of the device 30*a* which differ from the components of the device 30 will be described, it being understood that the common components function in essentially the same manner.

A conveying mechanism 312 includes a manually operable handwheel 314 which drives two advance units 316 and 318 by way of a shaft (not shown). The advance units 316 and 318 could, for example, be driven by an electric motor instead of the manually operable handwheel 314. A stop 320 is positioned to preclude advancement of the lead fastening element 44*a* beyond the assembly station 46. Two collection chambers, or troughs, 322 and 324 are provided to guide the scrap or residue guide elements 64 and the monofilaments 66 from within the head 38 of the fastening device 30*a* after the fastening elements 44 have been severed therefrom. The scrap guide elements 64 and monofilaments 66 which exit from the troughs 322 and 324 can be severed manually and separated from the trailing portions which remain in the head 38. As with the first embodiment, the magazine 36 and the head 38 of the fastening device 30*a* are tiltable as illustrated in FIGS. 21 and 22.

In general, the above-identified embodiments are not to be construed as limiting the breadth of the present invention. Modifications, and other alternative constructions, will be apparent which are within the spirit and scope of the invention as defined in the appended claims.

What is claimed is:

1. A fastening device for feeding and applying a plurality of serially linked fastening elements to a structure, which comprises:

a feed track for receipt of the serially linked fastening elements therein;

a housing containing an assembly station whereat each of successive leading ones of the serially linked fastening elements is to be positioned for assembly with the structure;

a conveying mechanism operable for selectively advancing the successive leading fastening element from the feed track to the assembly station;

a driver operable independently of the conveying mechanism for selectively separating each successive leading fastening element at the assembly station from the fastening elements which remain serially linked, and for advancing the separated leading fastening element from the assembly station into assembly with the structure;

the plurality of fastening elements being linked by a continuous web from which the lead fastening element is separated by the driver;

a guide way for directing the portions of the web from which the fastening elements have been separated to a location externally of the fastening device; and a cutter mechanism located to facilitate selective separation of the portions of the web which extend externally of the fastening device from trailing portions thereof which remain within the fastening device.

2. A fastening device for applying fastening elements from a forward end of the device to a structure, which comprises:

a magazine for receiving a predetermined number of the fastening elements in a web-connected manner, a magazine holder extending along an axis thereof from a first end to a second end thereof and arranged to support the magazine substantially in parallel with the axis thereof;

a housing part coupled to and extending in a given direction from the magazine holder toward the forward end of the device; and a conveyor arrangement supported by the housing part for conveying each fastening element from the magazine into a predetermined fitting position at the forward end of the fastening device whereat the conveyed fastening element can be applied from the fitting position to the structure; and the device is shaped generally in the configuration of a pistol.

3. A fastening device for applying fastening elements from a forward end of the device to a structure, which comprises:

a magazine for receiving a predetermined number of the fastening elements in a web-connected manner, a magazine holder extending along an axis thereof from a first end to a second end thereof and arranged to support the magazine substantially in parallel with the axis thereof;

a housing part coupled to and extending in a given direction from the magazine holder toward the forward end of the device; and a conveyor arrangement supported by the housing part for conveying each fastening element from the magazine into a predetermined fitting position at the forward end of the fastening device whereat the conveyed fastening element can be applied from the fitting position to the structure; and the magazine and the conveyor arrangement being mounted for pivotal movement about the axis of the magazine holder.

4. A fastening device for applying fastening elements from a forward end of the device to a structure, which comprises:

a magazine for receiving a predetermined number of the fastening elements in a web-connected manner, a magazine holder extending along an axis thereof from a first end to a second end thereof and arranged to support the magazine substantially in parallel with the axis thereof;

a housing part coupled to and extending in a given direction from the magazine holder toward the forward end of the device; and a conveyor arrangement supported by the housing part for conveying each fastening element from the magazine into a predetermined fitting position at the forward end of the fastening device whereat the conveyed fastening element can be applied from the fitting position to the structure; and wherein the conveyor arrangement comprises:

a support element which is movable about an axis thereof;

a plurality of projections coupled to, and extending from, a face of the support element;

a carrier element located on the housing part;

an end face associated with the carrier element and positionable for engagement individually and serially with the projections;

the carrier element being movable from a rest position to a forward position thereof with respect to the housing part in a direction to move the end face against an adjacent one of the projections thereby moving the adjacent projection and the support element; and means formed on the support element and responsive to movement of the carrier element for engaging at least a leading fastening element in the magazine and for advancing the leading fastening element toward the fitting position.

5. The fastening device as set forth in claim 4, which further comprises:

a recess formed in the housing part for slidable receipt of the carrier element therein.

6. The fastening device as set forth in claim 5, which further comprises:

a groove formed in the housing part in communication with the recess thereof and structured with an entry end for receipt of at least portions of the projections and an exit end from which the projections exit.

7. The fastening device as set forth in claim 6, which further comprises:

a blocking section formed on the carrier element located to block the exit end of the groove when the carrier element is in the rest position.

8. The fastening device as set forth in claim 4, which further comprises:

an advance element attached for pivotal movement to the carrier element; and the end face forming a portion of the advance element.

9. The fastening device as set forth in claim 8, which further comprises:

a spring located between the carrier element and the advance element for normally biasing the advance element in a prescribed pivotal direction relative to the carrier element.

10. The fastening device as set forth in claim 4, which further comprises:

a socket formed in the carrier element for at least partial receipt of one of the projections when the carrier element is in the rest position.

11. A fastening device for supplying fastening elements to a fitting position for subsequent insertion into a structure, which comprises:

a feeder for supplying a succession of web-connected serially-arranged fastener elements;

a support element which is movable about an axis thereof and which is located adjacent the feeder;

a plurality of projections coupled to, and extending from, a face of the support element;

a carrier element;

an end face associated with the carrier element and positionable for engagement individually and serially with the projections;

the carrier element being movable from a rest position to a forward position thereof in a direction to urge the end face into engagement with an adjacent one of the projections to move the adjacent projection thereby moving the support plate and the remaining projections; and means formed on the support element and responsive to movement of the carrier element for engaging at least a leading fastening element from the feeder and for advancing the leading fastening element toward the fitting position.

12. The fastening device as set forth in claim 11, which further comprises:

a housing part located adjacent the support element;

a recess formed in the housing part for slidable receipt of the carrier element therein.

13. The fastening device as set forth in claim 12, which further comprises:

a groove formed in the housing part in communication with the recess thereof and structured with an entry end for receipt of at least portions of the projections and an exit end from which the projections exit.

14. The fastening device as set forth in claim 13, which further comprises:

a blocking section formed on the carrier element located to block the exit end of the groove when the carrier element is in the rest position.

15. The fastening device as set forth in claim 11, which further comprises:

an advance element attached for pivotal movement to the carrier element; and the end face forming a portion of the advance element.

16. The fastening device as set forth in claim 15, which further comprises:

a spring located between the carrier element and the advance element for normally biasing the advance element in a prescribed pivotal direction relative to the carrier element.

17. The fastening device as set forth in claim 11, which further comprises:

a socket formed in the carrier element for at least partial receipt of one of the projections when the carrier element is in the rest position.

18. A fastening device for feeding and applying a fastening element to a structure, which comprises:

a feed track for receipt of the fastening element therein;

a housing containing an assembly station whereat the fastening element is to be positioned for assembly with the structure;

a conveying mechanism operable for selectively advancing the fastening element from the feed track to the assembly station;

a driver operable independently of the conveying mechanism for selectively advancing the fastening element from the assembly station into assembly with the structure; and the device being shaped generally in a configuration which facilitates the holding and handling of the device by an operator during the operation of the device.

19. A fastening device for supplying fastening elements to a fitting position for subsequent insertion into a structure, which comprises:

a feeder for supplying a succession of web-connected serially-arranged fastener elements;

a support element which is movable about an axis thereof and which is located adjacent the feeder;

a plurality of projections coupled to, and extending from, a face of the support element;

a carrier element;

an end face associated with the carrier element and positionable for engagement individually and serially with the projections;

the carrier element being movable from a rest position to a forward position thereof in a direction to urge the end face into engagement with an adjacent one of the projections to move the adjacent projection thereby moving the support plate and the remaining projections; and means formed on the support element and responsive to movement of the carrier element for advancing the leading fastening element toward the fitting position.

* * * * *